United States Patent [19]

Murano et al.

[11] 3,935,406

[45] Jan. 27, 1976

[54] VACUUM INTERRUPTER

[75] Inventors: Minoru Murano, Tokyo; Satoru Yanabu; Hitoshi Sodeyama, both of Yokohama, all of Japan

[73] Assignee: Tokyo Shibaura Electric Co., Ltd., Kawasaki, Japan

[22] Filed: June 25, 1974

[21] Appl. No.: 482,901

[30] Foreign Application Priority Data

June 30, 1973 Japan ..... 48-74202

[52] U.S. Cl. ..... 200/144 B; 313/156; 313/146; 313/161; 313/325; 317/74

[51] Int. Cl.[2] ..... H01H 9/30; H01H 33/00

[58] Field of Search ..... 313/325, 156, 146, 174, 313/161, 183; 315/36, 38; 317/61.5, 62, 73, 74, 75; 200/144 B, 147 R, 147 A

[56] References Cited

UNITED STATES PATENTS

| | | | |
|---|---|---|---|
| 3,225,167 | 12/1965 | Greenwood | 200/144 B |
| 3,622,724 | 11/1971 | Sofianek | 200/144 B |
| 3,764,764 | 10/1973 | Takasuna et al. | 200/144 B |
| 3,809,836 | 5/1974 | Grouch | 200/144 B |
| 3,818,164 | 6/1974 | Mizutani et al. | 200/144 B |
| 3,823,287 | 7/1974 | Bettge | 200/144 B |

*Primary Examiner*—Saxfield Chatmon, Jr.
*Attorney, Agent, or Firm*—Oblon, Fisher, Spivak, McClelland & Maier

[57] ABSTRACT

A vacuum interrupter includes a small sized, rigid exciting coil disposed immediately behind at least one main electrode so as to be connected at one end to a current carrying rod and at the other end to the main electrode, and consisting of a plurality of sectoral-shaped unit exciting coils arranged adjacent to each other in a plane substantially parallel to the surface of the main electrode and having the same polarity, in which, when electric currents branched from a main electric current are flowed through the respective unit exciting coils, magnetomotive forces generated due to the electric currents flowing radially of the unit exciting coils are cancelled with respect to each other and only the electric currents flowed through the arcuate sections of the unit exciting coils induce electromotive forces effective to produce magnetic fields in a direction perpendicular to the main electrode.

5 Claims, 7 Drawing Figures

VACUUM INTERRUPTER

This invention relates to a vacuum interrupter having behind each main electrode a plurality of unit exciting coils for generating a magnetic field in a direction perpendicular to the main electrode, under the influence of which an arc occurring between the main electrodes is rendered stabled and uniformly distributed.

A pair of main electrodes are generally kept in contact with each other when electric current is being flowed through a vacuum interrupter. Where at this time the main electrodes are moved away from each other by a suitable operating mechanism, there occurs an arc between the main electrodes which is maintained by a plasma emitted from a cathode. In an ordinary case, the occurrence of plasma is stopped at a point of time when electric current comes to a zero. Therefore, an arc can not be maintained and electric current is interrupted. Where, however, large electric current is flowed, an intense arc occurs. In this case, a resultant magnetic field resulting from a magnetic field created by the arc per se and magnetic field created by the other circuits (for example, exterior conductors to which each of a pair of current carrying rods is connected) acts on the arc per se to render it unstable. This causes the arc to be localized at the outer periphery, or its neighborhood, of the electrode surface, causing the corresponding electrode surface to be locally overheated to produce a large amount of plasma. As a result, a vacuum within a receptacle is lowered and thus an interrupting capability is lowered.

To avoid such disadvantages attempts have been made to make the surface of a main electrode wider to cause the density of electric current to be lowered or to provide spiral cuts in the surface of the main electrode to cause arc to be moved outward along the spiral groove. In the former case, there is still the possibility that arc will be localized at the peripheral surface of the main electrode, while in the latter case arc cannot be uniformly distributed over the entire surface of the main electrode. In either case, it is impossible to obtain a stable, uniformly distributed arc.

Where plasma escapes outward from between the main electrodes and no plasma sufficient to maintain the arc in a stable way is obtained, the surface of the main electrode is locally overheated with the resultant localized fusion. Namely, when plasma present between the main electrodes escapes, arc voltage is increased so as to maintain electric current. Since a greater amount of energy is supplied to the main electrode, the main electrode is locally overheated with the resultant localized fusion.

To prevent such phenomenon, it is known to apply magnetic field in a direction perpendicular to the surface of the main electrode. It is said that electrons, neutral atoms and ionized atoms are emitted at a ratio of about 100:10:1 from a cathode spot of arc. Out of these the electron and ionized atoms are primarily served to maintain an arc. A magnetic field applied in a direction perpendicular to the surface of the main electrode traps electrons along the magnetic field to prevent them from being dispersed outward from between the electrodes.

When electrons are so trapped between the main electrodes, electrons escaping outward from between the main electrodes are decreased to render arc stable. The movement of electrons causes the travel of electrons to the anode to be extended. During the travel of electrons to the anode the probability that the electrons will cause neutral atoms to be ionized is increased, thus replenishing deficient plasma to render arc stable. The magnetic field also acts on the ionized atoms to cause them to be trapped within between the electrodes. In this way, arc is confined, under the influence of magnetic field, within between the electrodes.

In an attempt to apply a magnetic field in a direction perpendicular to the surface of the main electrode, an exciting coil is provided around the outer periphery of a vacuum vessel and connected to the current carrying rod coupled to the main electrode, or the portion of the current carrying rod is wound in the form of a coil within a vacuum vessel and is connected to the main electrode. In the former case, however, it is difficult to obtain a magnetic field exhibiting a sufficient effect, since the exciting coil and electrode are spaced far away from each other. Furthermore, a fairly large-sized exciting coil is required, resulting in an expensive, bulky and weighty vacuum interrupter. In the latter case, the current carrying rod is complicated in construction and difficult to manufacture. Moreover, an inner construction becomes bulky and a vacuum interrupter as a whole becomes weighty and large-sized.

A primary object of this invention is to provide a vacuum interrupter in which a high interrupting capability is exhibited by causing an arc occurring between main electrodes to be uniformly and stably distributed over the surface of the main electrodes.

Another object of this invention is to provide a vacuum interrupter having within a vacuum vessel a small, rigidly constructed exciting coil in which a magnetic field is formed in a direction perpendicular to the surface of each main electrode so as to cause an arc occurring between the main electrodes to be uniformly and stably distributed over the surface of the main electrode.

To attain this object, there is provided a vacuum interrupter comprising a vacuum vessel; a pair of current carrying rods extending in an airtight fashion from the vacuum vessel and connected to an exterior electrical path to permit electric current to be passed therethrough; a pair of electrode units each mounted to the forward end of the respective current carrying rod with the electrode surfaces of the respective electrode units arranged opposite to each other and each having a main electrode admitting of the passage of electric current; a driving means by which at least one of the electrode units is moved into or out of engagement with the other electrode unit so as to cause the electric current to be flowed or interrupted; and an exciting coil mounted to at least one of said electrode units, consisting of a plurality of unit exciting coils arranged closely adjacent to each other in a plane substantially parallel to the surface of the main electrode, and having one end connected to the current carrying rod and the other end connected in parallel to the main electrode, in which said exciting coil includes a plurality of first arms connected to the current carrying rod and extending at an angle in a plane parallel to the main electrode and radially of the current carrying rod, a plurality of second arms connected to the main electrode, arranged close to the respective first arms and extending in a parallel, underlapped relation to the respective first arms with a space therebetween and a plurality of arcuate sections arcuately and integrally extending from the forward end of the first arm to the forward end of the second arm disposed close to the next first arm, whereby magnetomotive forces generated by branched electric currents flowed through the first and second arms are substantially cancelled with respect to each other and magnetic fields are created in a plane perpendicular to the surface of the main electrode by the branched electric currents flowed through the arcuate section.

The respective magnetic field created by the respective unit exciting coils act on the surface of the main electrode as a magnetic field to cover the entire surface of the main electrode. The respective magnetic fields not only prevent an escape of arc by trapping a plasma for maintaining the arc occurring between the main electrodes, but also serve to cause electrons present in the plasma to be moved toward an anode during which there is a chance that neutral atoms are ionized by the electrons, thus facilitating the generation of plasma. As a result, arc is rendered stable and uniformly distributed over the surface of the main electrode. According to this invention, therefore, a vacuum interrupter having a high interrupting capability is obtained without involving any overheat or thermal welding due to the arc being localized at the peripheral surface, or its neighborhood, of the main electrode.

An increase or decrease in number of units exciting coils permits the strength of magnetic field created over the entire surface of the exciting coil to be decreased or increased. When the magnetic field created over the electrode surface is so selected as to have a value near to that most appropriate for current interruption, a vacuum interrupter having a high interrupting capability can be obtained without the necessity of making the device too large. In this case, a magnetic field of the exciting coil is substantially equal to a magnetic field created by causing a branched electric current flowed through each unit exciting coil to be flowed through an imaginative coil of one turn which is obtained by connecting the respective arcuate sections together.

Where a contact having a relatively high vapor pressure and admitting of difficult welding is mounted at the forward end of the main electrode, arc is concentrated on the contact in the neighborhood of a zero point of arc current and under the influence of a magnetic field the arc can be substantially uniformly distributed over the surface of the contact.

Where a plurality of slits are provided in the main electrode in a manner to extend non-rectilinearly from near the center of the main electrode and be open at the outer periphery of the main electrode, arc is moved outward along the slits and an eddy current developed at the main electrode by the magnetic field of the exciting coil is decreased. As a result, arc can be rendered more stable and more uniformly distributed due to the presence of the contact and under the influence of magnetic field.

Where a magnetic field created by the exciting coil relatively weakly acts on the central portion of the contact and arc is localized at this portion, a through bore is provided in the central portion of the contact to avoid the localization of arc.

This invention is further explained with reference to the accompanying drawings, in which.

Figure 1:
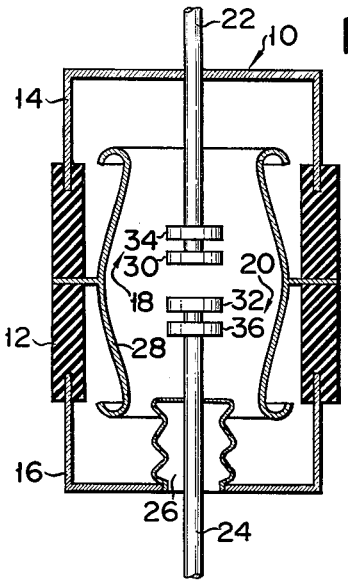
FIG. 1 is a view showing the construction of a vacuum interrupter according to this invention.

FIG. 1 is an explanatory view showing a diagrammatic construction of a vacuum interrupter according to one embodiment of this invention. A vacuum vessel 10 of the vacuum interrupter has an insulating cylindrical body 12 closed by cap members 14, 16. The vessel 10 houses a pair of similar electrode units 18, 20 arranged opposite to each other. The electrode units 18 and 20 are mounted to the ends of current carrying rods 22 and 24, respectively. The current carrying rod 24 and thus the electrode unit 20 are reciprocably moved up and down by an operating mechanism not shown. The vacuum interrupter is opened and closed by the up and down movement of the current carrying rod 24. A bellows 26 is provided to permit the current carrying rod 24 to be moved up and down in an airtight fashion. 28 is a shield provided to enclose the electrode units 18 and 20.

The electrode unit 18 has a main electrode 30 and an exciting coil 34, while the electrode unit 20 has a main electrode 32 and an exciting coil 36. When the electrode units 18 and 20 are contacted with each other, the vacuum interrupter is rendered conductive to cause main electric current to be passed through the current carrying rods 22, electrode unit 18, electrode unit 20 and current carrying rod 24. To cut off the main electric current, one current carrying rod and corresponding electrode unit mounted to the current carrying rod are moved away from the other current carrying rod and corresponding electrode unit so that the main electrodes 30 and 32 are spaced apart from each other. Through the exciting coils 34 and 36 the main electric current is passed to create magnetic field in a direction perpendicular to the surface of the main electrodes 30 and 32.

Figure 2:
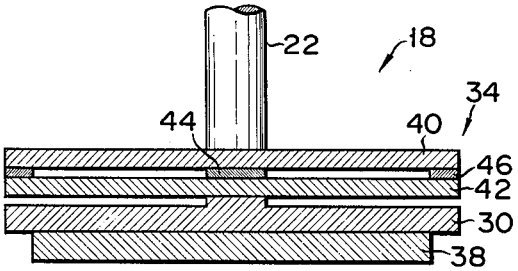
FIG. 2 is a cross-sectional view of an electrode unit used in the vacuum interrupter.

FIG. 2 shows a cross-sectional view of the electrode unit 18 mounted to the current carrying rod 22. The electrode unit 20 is identical in construction to the electrode unit 18 and explanation is, therefore, restricted only to the electrode unit 18.

Figure 3:
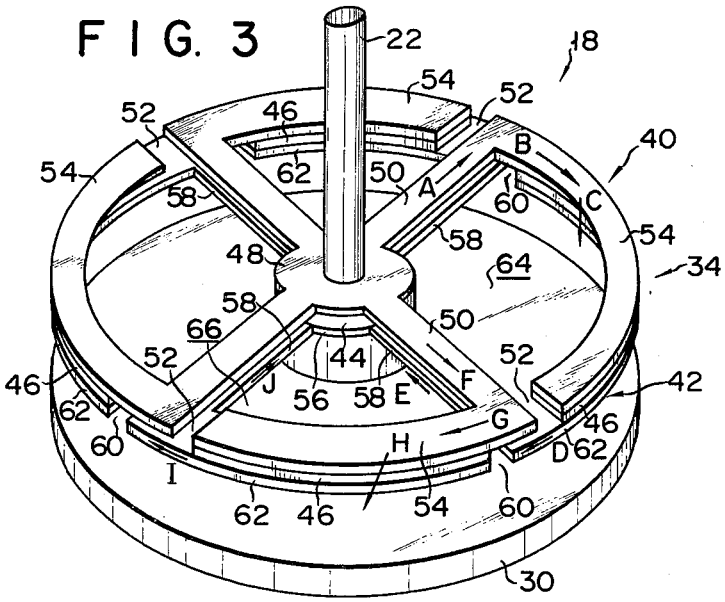
FIG. 3 is a perspective view of the electrode unit.

FIG. 3 shows the exciting coil 34 and main electrode 30 included in the electrode unit 18. A space between the exciting coil 34 and the main electrode is exaggerated for ease in understanding.

As shown in FIG. 2 the electrode unit 18 has the exciting coil 34 and main electrode 30. 38 shows a contact included in the main electrode 30. The contact 38 may be omitted if current interruption requirements permit. The exciting coil 34 has first and second coil conductors 40 and 42 as well as an intermediate member 44 and connecting conductor 46 disposed between the first and second coil conductors 40 and 42 and adapted to connect the first and second coil conductors 40 and 42 in a spaced apart relation.

When main electric current is flowed through the current carrying rod 22, it is passed from the current carrying rod 22 through the first coil conductor 40, connecting conductor 46 and second coil conductor 42 to the main electrode 30 and then directly, or through an arc, to the other main electrode 32. When the main electric current is passed through the exciting coil 34, a magnetic field perpendicular to the surface of the main electrode 30 is created under the magnetomotive force of the electric current. The intermediate member 44 disposed between the first and second coil conductors 40 and 42 is used to support the first and second coil conductors at their center in an electrically separated, but mechanically integrated fashion.

In the exciting coil 34 shown in FIG. 3, the first coil conductor 40 comprises a first central conductor 48 fitted over the current carrying rod 22, four first arms 50 radially and equiangularly extending from the first central conductor in a plane perpendicular to the current carrying rod 22 and having an equal length, first arcuate sections 54 extending from the forward end of the first arm toward the forward end of the adjacent first arm in a manner to describe an arc with a suitable gap left between the free end of the arcuate section and the forward end of the adjacent first arm. The first arcuate sections 54 each extend in the same direction from the forward end of the first arm. In FIG. 3 the first arcuate sections 54 all extend in a clockwise direction when viewed from atop of the Figure. The second coil conductor 42 has a second central conductor 56 at its center which is connected through the intermediate member 44 to the first central conductor 48. The intermediate member 44 is usually made of a high resistance metal such as, for example, stainless steel. The member 44 may be made of a rigid insulating material. From the second central conductor 56, four second arms 58 extend in a parallelly underlapped, spaced-apart relationship to the respective four first arms 50 and have a length the same as that of the first arms 50. From the forward ends of the second arms 58, second arcuate sections 62 respectively extend counter-clockwise viewed from atop of FIG. 3 in a parallelly underlapped, spaced-apart relation to the first arcuate sections 54, leaving a suitable gap 60 between the free end of the second arcuate section and the forward end of the adjacent second arm. The first and second arcuate sections 54 and 62 and the connecting conductor 46 disposed between the first and second arcuate sections are integrally connected together so that they can be rendered conductive.

The main electrode 30 having a contact 38 fixed as desired at its end is mounted to the second coil conductor 42.

Let us now explain the case where electric current is cut off by moving the main electrode unit 20 away from the main electrode unit 18.

When the main electrode unit 20 is moved away from the main electrode unit 18 using an operation mechanism (not shown), an arc is generated between the main electrodes 30 and 32. A flow of arc current from the current carrying rod 22 to the current carrying rod 24 will be explained by reference to FIG. 3. Arc current is flowing from the current carrying rod 22 into the first central conductor 48 where it is flowed through the four first arms i.e. branched in four directions as indicated by an arrow A. That is, the branched current is flowed, along the direction indicated by arrows A, B, C, D and E, through a unit exciting coil 64 of one turn consisting of the first arm 50, first arcuate section 54, connecting conductor 46, second arcuate section 62 and second arm 58; meets at the second central conductor 56; and is further flowed from the main electrode 30 through an arc into the other electrode unit 20. Each electric path through which the branched current is passed is usually made of a low resistance material such as, for example, copper or copper alloy. In contrast, the intermediate member 44 is made of a high resistance material. Therefore, less current is flowed through the intermediate member 44 and most of current is flowed through the unit exciting coil 64.

In a unit exciting coil 66 adjacent to the unit exciting coil 64 the branched current is flowed in a direction indicated by arrows F, G, H, I and J and magnetic field is generated in the same direction as that of the unit exciting coil 64.

Thus, all the unit exciting coils included in the exciting coil 34 each generate a magnetic field perpendicular to the surface of the main electrode 30. Since each unit exciting coil has the first and second arms 50 and 58 underlapped with respect to each other, magnetomotive forces developed at the first and second arms are substantially cancelled with respect to each other, and magnetomotive forces developed at four arcuate conducting portions each consisting of the first and second arcuate sections 54 and 62 and connecting conductor 46 contribute to the formation of the above-mentioned magnetic field. The magnetic field of the exciting coil 34 is substantially equal to a magnetic field created by causing a branched current flowed through each unit exciting coil to be flowed through an imaginative coil of one turn which is obtained by connecting the respective arcuate sections together.

The exciting coil 34 is provided one on the electrode unit 18 and one on the electrode unit 20. Where, however, a weak magnetic field is allowed, the exciting coil is provided on only one of the two electrode units 18 and 20.

In FIG. 3 the exciting coil 34 consists of the four unit exciting coils 64 and 66. When the unit exciting coils are provided in numbers of 2, 3, 6 . . . $n$, a branched current flowed through each unit exciting coil will become 1/2, 1/3, 1/6 . . . $1/n$, respectively, of arc current, and the magnetic field to be induced will have an intensity corresponding to 4/2, 4/3, 4/6 . . . $4/n$ times, respectively, as compared with that of the magnetic field obtained from the arrangement of FIG. 3. The cross-sectional area of the respective unit exciting coils 64 and 66 is suitably selected dependent upon the magnitude of the branched current. The strength of magnetic field can be varied by forming the exciting coil 34 as mentioned above.

Figure 4:
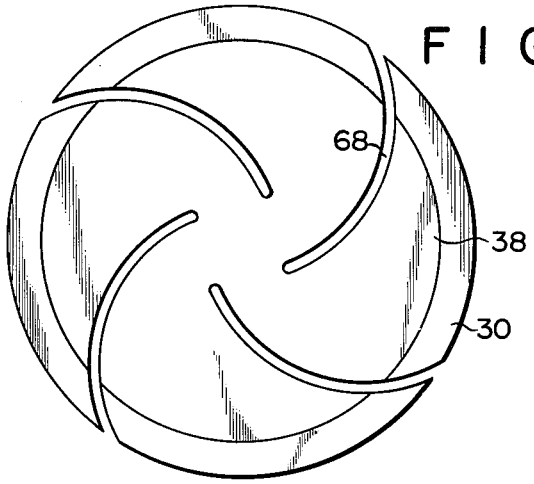
FIG. 4 is a plan view of a contact-equipped main electrode in which a plurality of slits are provided.
Figure 5:
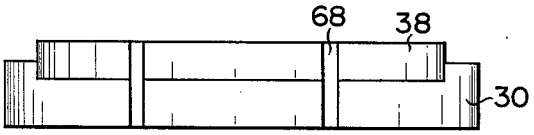
FIG. 5 is a side view showing the main electrode of FIG. 4.

FIGS. 4 and 5 show spiral slits provided in a manner to pierce through the main electrode 30. Where the contact 38 is mounted to the main electrode, the spiral slit is formed in a manner to extend through the main electrode 30 and contact 38 as shown in FIG. 4. The spiral slit causes arc to be moved therealong and restricts an eddy current generated at the main electrode 30 by the magnetic field of the exciting coil to cause a suitable axial magnetic field to be induced to permit the arc to be substantially uniformly distributed over the surface of the main electrode 30, thereby preventing the main electrode 30 from being locally overheated or thermally welded. One experiment proves that, when the main electrodes 30 and 32 are spaced apart from each other, arc is distributed within a few milliseconds over the entire surface of the main electrode 30.

The contact 38 is made of material, for example, a ternary alloy consisting of Cu, Te and Se, having a relatively high vapor pressure as compared with the main electrode 30 and admitting of difficult welding. The contact 38 permits most of arc to be generated from its surface at a point near to a zero point of arc current, and the arc is substantially uniformly distributed over the surface of the contact 38 by magnetic field created by the exciting coil 34. Therefore, the arc is made stable and the surface of the main electrode 30 is not locally injured.

Figure 6:
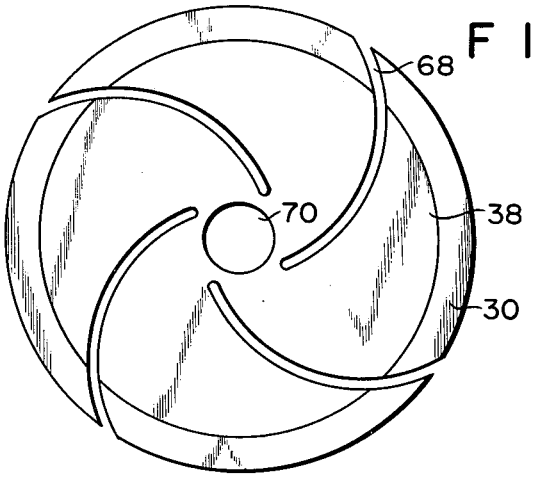
FIG. 6 is a plan view showing a main electrode similar to that of FIG. 4, in which a through bore is provided in a contact.
Figure 7:
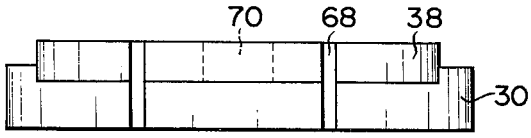
FIG. 7 is a side view of the main electrode of FIG. 6.

When a through bore 70 is provided in the central portion of the contact 38 as shown in FIGS. 6 and 7, the main electrode 30 can be prevented from being locally overheated or thermally welded at the corresponding central portion. Namely, though the contact 38 is made of an easily ignitable material, it has a through bore at its central portion. As a result, arc is prevented from being concentrated on the central portion of the contact 38, where the magnetic field of the exciting coil 34 is weak.

If the main electrode 30 is all made of such a material as used for the contact 38, a better effect is obtained. However, a material suitable for the contact 38 is usually hard and brittle and difficult to be machined, and the contact 38 is subject to limitation on its size and shape. Therefore, the contact 38 of a suitable size is mounted to the front surface of the main electrode 30. If the size and shape of the main electrode 30 permit, the main electrode 30 may be formed of a material suitable for the contact 38.

With the vacuum interrupter according to this invention, a small-sized, strong exciting coil 34 consisting of a plurality of unit exciting coils 64, 66 is provided behind at least one of the pair of main electrodes 30 and 32, as explained above, and a magnetic field of suitable magnitude is created perpendicular to the surface of the main electrodes 30 and 32 without rendering the vacuum interrupter weighty and largesized. The magnetic field not only prevents an escape, from between the main electrodes, of plasma which defines an arc when the main electrodes 30 an 32 are moved away from each other, but also facilitates the generation of plasma and maintains the arc stably, thereby causing the arc to be distributed uniformly over the surface of the main electrodes 30 and 32. Thus, the surface of the main electrode is prevented from being locally overheated or thermally welded due to the non-uniform distribution of arc or excessively localized arc, whereby the interrupting capability of the vacuum interrupter is enhanced. The uniform distribution of arc as well as the stabilization of arc is further facilitated by mounting the contact 38 to the surface of the main electrodes 30 and 32, providing, for example, the spiral slits in a direction perpendicular to the surface of the main electrodes 30 and 32, and providing the through bore 70 at the central portion of the contact 38. As a result, it is possible to provide a vacuum interrupter having a high interrupting capability.

What we claim is:

1. A vacuum interrupter comprising a vacuum vessel; a pair of current carrying rods extending in an airtight fashion from the vacuum vessel and connected to an exterior electrical path to permit a main electric current to be passed therethrough; a pair of electrode units, each mounted on the forward end of the respective current carrying rod with the electrode surfaces of the respective electrode units arranged opposite to each other and each having a main electrode carrying the electric current, at least one of said electrode units being movable into or out of engagement with the other electrode unit so that the main electric current is conductive or interrupted by a suitable driving means; and an exciting coil mounted to at least one of said electrode units, consisting of a plurality of unit exciting coils arranged adjacent to each other in a plane substantially parallel to the surface of the main electrode, and having one end connected to the current carrying rod and the other end connected in parallel to the main electrode, said unit exciting coils including a plurality of first arms connected to the conducting rod and extending at an angle in a plane parallel to the main electrode and radially of the current carrying rod, a plurality of second arms connected to the main electrode, arranged close to the respective first arms and extending in a parallel, underlapped relation to the respective first arms with a space therebetween and a plurality of arcuate sections arcuately and integrally extending from the forward ends of the first arms to the forward ends of the second arms, disposed close to the next first arm, whereby magnetomotive forces generated by branched electric current flowing through the first and second arms are substantially cancelled with respect to each other and magnetic fields are created in a plane perpendicular to the surface of the main electrode by the branched electric currents flowed through the arcuate sections.

2. A vacuum interrupter according to claim 1 in which said plurality of arcuate sections are a plurality of first arcuate sections each arcuately extending in one direction from the forward end of the first arm toward the forward end of an adjacent first arm with a gap left between the free end of the arcuate section and the forward end of the adjacent first arm, a plurality of second arcuate sections, each arcuately extending in a direction opposite to that of the first arcuate section from the forward end of the second arm toward the forward end of an adjacent second arm with a gap left between the free end of the arcuate section and the forward end of the adjacent second arm, and a plurality of connecting conductors each disposed between the first and second arcuate sections and electroconductively connected to the first and second arcuate sections to form an arcuate section of the unit coil.

3. A vacuum interrupter according to claim 1 in which said main electrode has a contact mounted at its end.

4. A vacuum interrupter according to claim 3 in which said main electrode has a plurality of slits provided in a manner to pierce through a main electrode, said slits extending non-rectilinearly from near the central portion of the main electrode and being opened at the peripheral surface of the main electrode.

5. A vacuum interrupter according to claim 4 in which said contact has a through bore provided at its central portion to prevent localization of arc.

* * * * *